United States Patent [19]

Burkhart

[11] 4,097,172

[45] Jun. 27, 1978

[54] COLD-PATCHING

[75] Inventor: Gerald W. Burkhart, Monaca, Pa.

[73] Assignee: Arco Polymers, Inc., Philadelphia, Pa.

[21] Appl. No.: 753,052

[22] Filed: Dec. 21, 1976

[51] Int. Cl.[2] ..... E01C 7/35

[52] U.S. Cl. ..... 404/75

[58] Field of Search ..... 404/77, 75, 82, 32; 106/10

[56] References Cited

U.S. PATENT DOCUMENTS

| | | | |
|---|---|---|---|
| 2,039,026 | 4/1936 | Pease | 404/75 |
| 2,413,901 | 1/1947 | Abernathy | 404/32 X |
| 2,934,452 | 4/1960 | Sternberg | 404/75 X |
| 3,761,190 | 9/1973 | Thaning | 404/82 |
| 3,891,585 | 6/1975 | McDonald | 404/32 X |
| 3,907,449 | 9/1975 | Bennett | 404/72 X |
| 3,915,582 | 10/1975 | Clarke | 404/75 |
| 3,930,100 | 12/1975 | McDonald | 404/32 X |

OTHER PUBLICATIONS

The Condensed Chemical Dictionary, sixth edition, © 1956, 1961; Reinhold Publishing Corp., N.Y. p. 918

*Primary Examiner*—Nile C. Byers
*Attorney, Agent, or Firm*—Hubert E. Evans

[57] ABSTRACT

Improved cold patching of pavements, drives, walks, or the like, is obtained by applying to or mixing with the patching material a solution of thermoplastic polymeric resin. When the solution has evaporated or the solvent is volatilized, the patch and the surrounding area are reinforced and more thoroughly bonded together. If the area requiring repair has appreciable depth, it is preferable that the margins of the repair area receive an application of the polymeric resin solution so that the bond between the patch and the adjacent area is reinforced and made more secure.

8 Claims, No Drawings

COLD-PATCHING

BACKGROUND OF THE INVENTION

The present invention relates primarily to cold-patching of asphalt structures, such as pavements for streets, drives, walkways, and the like. It may also be useful in the patching of concrete structures.

It is common when a pavement, walk, or the like, becomes deteriorated to patch the surface of deteriorated area without reconstructing the entire unit. For this purpose, cold patch materials are widely used, and they usually comprise a mixture of asphalt, tar and a suitable aggregate, such as, gravel. The patched material is mixed, applied to the deteriorated area or cavity and bonded thereto usually by means of pressure and/or heat, such as, by a compacting tamper type of apparatus.

One of the problems encountered in older asphalt surfaces or stratas, or in areas which have been cold patched, arises from the action of moisture which has fallen in the form of rain or snow, has penetrated the deteriorated area, and may have become frozen due to the ambient temperature. While the asphalt and tar materials used in the paving or in the cold patching are themselves water repellant, interstices occur, probably due to the traffic thereover, and water does seep or penetrate into the asphalt strata. As it freezes it expands and contracts upon thawing, and over a period of time results in deterioration of the traffic surface. The freeze-thaw expansion and contraction encountered in the winter result in deteriorated cavities which are aggravated by the traffic thereover, and are commonly known as "pot holes" Cold patching of such conditions can be done to render them less hazardous to traffic until it is necessary or desired to replace the pavement or drive.

SUMMARY

The present invention provides a method of repairing deteriorated areas of pavement which provides added reinforcement, increased water repellancy, and better adherence between the patch and the existing surrounding area. This is accomplished by coating the cold-patch material or mixing therewith a solution of a thermoplastic polymeric resin. The solvent causes high penetration into the patching material and the area adjacent the patch carrying the resin into such locations. After the resin has volatilized a thermoplastic resin is provided which adds strength to the patched area, provides greater water repellancy for the patched area and more firmly secures the patch to the surrounding area. Where the deteriorated area is of appreciable depth the resin solution is preferably applied to the cavity walls surrounding the cavity. The solvent for the resin is generally also a solvent for the asphalt or tar or other bitumen in the pavement, and thus penetrates both into the patch and into the surrounding area carrying the resin with it so that it will be present after the patching is completed. In small patches it may be adequate to paint the patch material with the resin, however, for larger patching it is preferable that the resin solution be thoroughly mixed with cold patching material prior to its application for repairs.

DETAILED DESCRIPTION

In carrying out the present invention almost any suitable polymeric material may be employed. It is important that the polymer be readily available. Thermoplastic polymeric resins are considered preferable. It is believed that in the presence of heat and pressure in the patch and surrounding area a thermoplastic material will be advantageous, especially when the pressure and heat are such that they will cause a softening of the resin and it will accommodate itself to movement much more so than if it were brittle. It is desirable that the resin have adequate compressive strength so that it will serve as a reinforcement for the patch and the surrounding area. Suitable solubility is also another property desired in the resin material, and in this instance it is advantageous that the resin be soluble in a solvent that is also a solvent for the bitumen, (i.e. asphalt and tar). Economic factors tend to dictate that low cost resins be used, although, in many instances it will be possible to utilize resins that may be of low cost because they are off grade for their primary commercial purpose and such materials may be advantageously used for patching purposes.

A number of good solvents are available for use in the present invention. The solvent should be a non-aqueous substance to preserve the high water repellancy properties of the patch and surrounding area. It is desired that the solvent have high volatility so that it is more readily evaporated or removed from the patch and surrounding area leaving behind the desired presence of thermoplastic polymeric resin. For purposes of handling and using the solvent it should obviously be non-toxic to personnel. It is also preferable that the solvent have good penetrating power so that it will carry the resin material into the interior of the patch and into the interior of the surrounding area to more adequately bond the polymeric resin with the patch and surrounding area. The cost of the solvent is, of course, a factor, but it has been found that waste solvents from various chemical processes can be used and are available at low cost. Examples of suitable solvents are toluene, xylene, naphtha and benzene, it being recognized that benzene is less desirable since it does have some toxic effects.

The strength of the solvent solution should be as high as feasible so that as much as possible of the resin material is deposited in the patch and surrounding area. On the other hand a less concentrated solution will generally have greater penetrating powers. For general patching purposes it is recommended that the resin solution have a concentration of about 20 to 30% to provide enough resin so that structural strength of the patch and the patched area will be significantly increased.

The amount of solution with respect to the cold-patch material to be used can vary widely. For small patches or surface repairs without appreciable depth, it is adequate that the patch to be used have applied thereto by spray painting or other suitable means an exterior coat of the solution, similarly the area surrounding the patch may have applied thereto a coating of the resin solution. If the size and/or depth of the area to be patched is significant, it is desired that the resin solution be mixed throughout the patch material. It is generally preferable that the solution should be used on the order of about 5 to about 10% by weight of the patch material.

In carrying out the invention the resin solution is applied to or mixed with the patch material. The patch material is placed in the deteriorated area, and then may be compacted such as by rolling or by vibrating compaction. In some instances, the use of heat as well as pressure may be desired. The use of heat is advantageous by causing volatilization of the solvent after the solvent has penetrated the patch and the area surrounding it so that the polymeric resin material is deposited within the patch and the patched area. For increasing the bond of the patch to the surrounding area it is best to apply, by painting or daubing, some of the resin solution to the wall of the cavity and the area surrounding the patch and allowing penetration into the pavement or walk. When the patch has been applied and the solvent has volatilized there will be an interconnecting network of resin material extending between the patch and the surrounding area, thus increasing the bond of the patch to the pavement.

When the patching is complete the deteriorated portion of the pavement or drive has been replaced by a bulk of cold-patching material together with and intimately admixed therethrough is the polymeric resin. This reinforces the strength of the patching material, provides greatly increased water repellancy in the patched area and more securely bonds the patch to the original material of the pavement, drive, or walk.

I claim:

1. In the method of cold patch repairing deteriorated paved areas by the addition of cold patch asphalt material, the step which comprises applying to the cold patch material prior to its application a polymeric thermoplastic resin dissolved in a volatile solvent whereby when the solvent has volatilized, said polymeric resin is present in both the patch material and the adjacent deteriorated paved areas to interconnect the same and the patch and the patched area are reinforced and more firmly adhered together by the presence of said polymeric resin.

2. The method of claim 1 in which the solution of thermoplastic resin is applied adjacent the location of the patch and allowed to penetrate thereinto before the patch is applied.

3. The method of claim 1 in which the thermoplastic resin is polystyrene.

4. The method of claim 1 in which the solvent is toluene.

5. The method of repairing by cold patching a deteriorated pavement surface area which comprises:

a. applying polystyrene dissolved in a volatile solvent to the deteriorated pavement area,
b. applying polystyrene dissolved in a volatile solvent to the cold patch material,
c. placing the treated cold patch material in the treated cavity of the deteriorated area,
d. applying pressure to said patched area,
e. allowing the solvent to volatilize and leaving deposited therethrough the polystyrene, whereby said deteriorated area and the cold patch applied thereto are interconnected by said polystyrene throughout the patch and the surrounding area to securely connect the cold patch material to the surrounding area.

6. The method described in claim 5 in which the solution of polystyrene is thoroughly admixed with the cold patch material prior to its application.

7. In the method of cold patching pavement areas by applying a cold patch material to the deteriorated area and adhering the patch thereto by pressure, the step which comprises admixing with the cold patch material about 5 to 10% of a solution of thermoplastic resin containing about 20 to 30% by weight of said resin in a volatile solvent prior to applying said patch to said deteriorated area.

8. The method of cold patching in claim 7 in which the solution of thermoplastic resin is also applied to the area adjacent the location to be patched.

* * * * *